United States Patent [19]

Mugnai et al.

[11] 4,204,379

[45] May 27, 1980

[54] CLOSED CIRCUIT SHRINK TUNNEL

[75] Inventors: Giorgio Mugnai; Paolo E. Vietto, both of Milan, Italy

[73] Assignee: W. R. Grace & Co., Duncan, S.C.

[21] Appl. No.: 939,748

[22] Filed: Sep. 5, 1978

[51] Int. Cl.[2] ..... B65B 31/02; B65B 53/06

[52] U.S. Cl. ..... 53/512; 34/92; 53/557

[58] Field of Search ..... 53/557, 512; 34/92, 34/202, 201, 218; 219/380

[56] References Cited

U.S. PATENT DOCUMENTS 3,010,216 11/1961 Ravet ..... 34/92

3,309,835 3/1967 Peppler ..... 53/557

4,164,111 8/1979 Di Bernardo ..... 53/512 X

FOREIGN PATENT DOCUMENTS 934389 8/1963 United Kingdom .

*Primary Examiner*—Travis S. McGehee

*Attorney, Agent, or Firm*—John J. Toney; William D. Lee, Jr.; John B. Hardaway

[57] ABSTRACT

A shrink tunnel for use in shrink packaging of articles with shrinkable films comprises a gaseous return flow, having a working section along which gas passes from an inlet to an outlet in a substantially rectilinier direction, and a return section around which the gas is recirculated for heat and velocity boosting prior to the next cycle through the working section.

9 Claims, 4 Drawing Figures

CLOSED CIRCUIT SHRINK TUNNEL

The present invention relates to shrink packaging and in particular to a shrink tunnel for shrinking a plastics envelope enclosing a product, in order to form a tightly wrapped package.

It is known to use air to impart shrinkage heat to a thermoplastic film envelope around a product, so as to achieve shrinkage of the enveloping film and thereby to provide a tidier package. However, traditional shrink tunnels have consisted ofenclosures through which the packages are gradually moved at a relatively low rate of travel, and across which enclosures hot air is blasted so that at various points in the passage of the product through the tunnel the film enveloping the product is subjected to shrinkage heat. However, because of the relatively high temperature of the air required in order to achieve high heat transmission rates to the bag, conventional shrink tunnels either need a long dwell time for the shrinkage step or they are liable to cause burning of certain areas of the bag.

It is an object of the present invention to provide a hot gas shrink tunnel in which high mass flow rates of shrinkage gas can be used thereby enabling high shrinkage gas temperatures to be avoided, or alternatively enabling short heating times to be employed, whilst still giving a relatively high thermal transmission rate to the bag and hence effecting adequate shrinkage with only a short dwell time.

According to the present invention there is provided a shrink tunnel for use in shrink packaging articles, comprising a return flow shrink tunnel having a working section along which in use, gas passes from an inlet end to an outlet end along a substantially rectilinear direction, and a return section round which the gas is recirculated for heating and velocity boosting before next arriving back at said inlet end of the working section.

Preferably the shrinkage gas is air. More preferably the shrinkage air is urged around the return flow tunnel by means of a fan which induces air flow across a heater, to maintain the temperature of the circulating air in the tunnel despite the transmission of heat to a package being shrunk. Desirably the fan is driven at a variable speed and the fan speed is controlled, together with the energy supply to the heater, by a control system responsive to air temperature in the tunnel.

Advantageously a support member is mounted for movement into and out of the working section of the shrink tunnel for bringing a closed, heat-shrinkable bag into the path of hot shrink air passing through the working section of the tunnel.

In a particularly convenient embodiment of the tunnel of the present invention, the working section may be constructed as a vacuum chamber with means for alternately diverting the hot shrink air around the vacuum chamber or passing it through the vacuum chamber. More conveniently the vacuum chamber may include means for gathering the neck of a bag and for closing the neck under vacuum, for example by the application of a metal closure clip. Suitably the means for alternately diverting the air around the chamber, or passing it through the chamber, may comprise a pair of shutters which in a first position guide all the hot shrink air to one side of a baffle and past the location where a filled bag will, in use, be positioned, and in a second position define, together with the baffle, a vacuum chamber past the outside of which the air is caused to flow.

The present invention also relates to a shrunk package formed using the shrink tunnel defined above.

In order that the present invention may be more readily understood the following description is given, merely by way of example, reference being made to the accompanying drawing in which.

Figure 1:
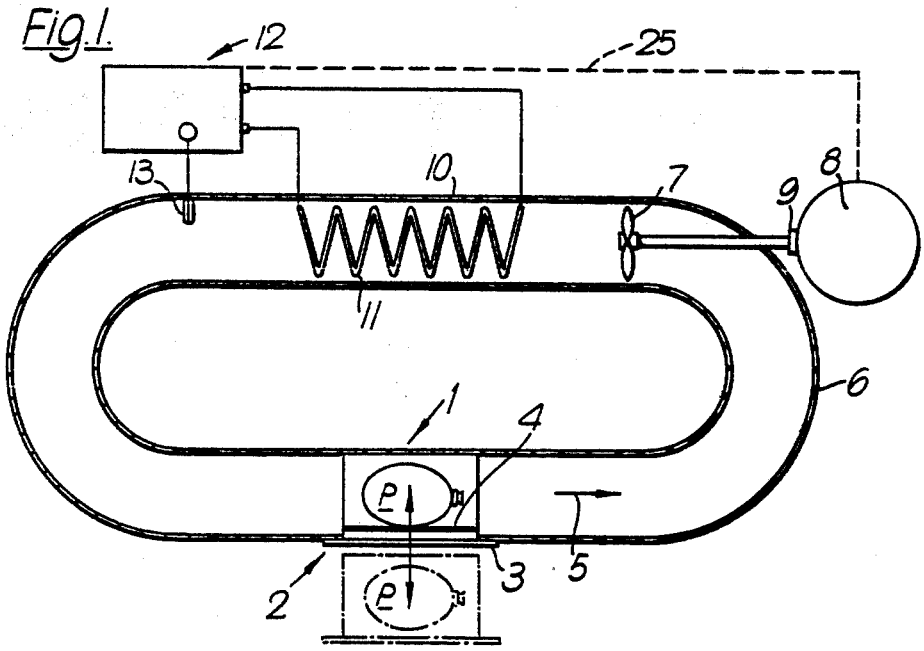
FIG. 1 is a schematic side elevational view of a first embodiment of gas shrinking apparatus in accordance with the present invention.

Referring now to FIG. 1, there can be seen, in 'schematic' representation, a closed circuit shrink tunnel having its walls lined with a thermal insulation, and in which the working section 1 has a package P consisting of a bagged product positioned therein by being mounted on a support member 2 which consists of a closure plate 3 for the side wall of the working section of the tunnel and a grid-type package support 4 spacing the bottom of the package P from the edges of the working section of the tunnel thereby ensuring that the hot shrinking gas is able to pass all around the package periphery and the wall of the working section 1.

The direction of flow of shrinking gas, in this case air, through the tunnel is illustrated by double headed arrow 5 and follows an anti-clockwise path as viewed in FIG. 1 around the first bend 6 in the tunnel and then to the circulator fan 7 driven by motor 8.

Although not illustrated in detail in the schematic view of FIG. 1, the drive from motor 8 to the fan 7 is by way of a variable speed pulley mechanism schematically depicted at 9, this enabling the rate of gas flow around the tunnel, induced by the fan 7, to be controlled.

In the return section 10 of the tunnel is a heater 11, in this case an electrical resistance heater, the supply to which is controlled by a control device 12 which is also connected to a temperature sensing transducer 13 in the return circuit but downstream of the heaters.

From the temperature transducer 13 the heated gas through the tunnel passes into the final bend and thence back to the upstream end of the working section 1.

The fan 7 sweeps substantially the entire cross-sectional area of the working circuit just downstream of the first bend 6 and thereby ensures that the cross-section of the moving body of gas within the tunnel is as extensive as possible, leaving only a thin boundary layer on the tunnel walls. The speed of operation of the fan 7 is also such that relatively high gas flow velocities (for example of the order of 600 to 1300 meters/minute) can be obtained. If desired, the speed of movement of the air can be increased to any desired value above 1300 meters/minute, it being understood that the rate of travel of air over the surface of the package will be dictated by the shrinking heat requirements of the film enveloping the product in the package P, and by the temperature of the gas flow.

Although, throughout the present specification, the term "gas flow" is referred to, it will be understood that in practice the use of air will make for a cheap shrinking gas.

In the embodiment schematically shown in FIG. 1, the package support member 2 is shown as being vertically movable, between the solid line position in which it holds the package P centrally within the working section of the tunnel, and the broken line position in which the now shrunk package P can be removed from the support and replaced by a fresh, sealed package to be shrunk.

If desired, a multiple package support can be used such that while one package is being shrunk in the working section of the tunnel one or more other package supports can be accessible for removal of the shrunk package and replacement by a fresh one to be shrunk. In this way, steps can be taken to ensure that the highest possible utilisation of the working time of the tunnel can be devoted to shrinking operations.

If desired, it may also be possible for the working section of the tunnel to include a by-pass unit so that while a package support 2 with package P thereon is being moved into or out of the working section of the tunnel the air flow can be diverted through the by-pass section in order to maintain the uniformity of temperature and air flow conditions in the return circuit of the tunnel so that when next the by-pass circuit is switched out and air is directed along the main working section there will be no delay before maximum shrink heat-imparting effect can be obtained from the circulating gas stream.

A first alternative embodiment of the shrink tunnel of the present invention is shown in FIG. 2, again in the form of a return flow tunnel. The fan 7, motor 8, pulley drive 9, return circuit 6, 10, heater 11, control device 12 and transducer 13 are all identical to the corresponding components shown in FIG. 1. The main difference between the FIG. 1 and FIG. 2 embodiments lies in the working section where, in the case of FIG. 2, there is a vacuum chamber provided in the working section of the tunnel.

Figure 2:
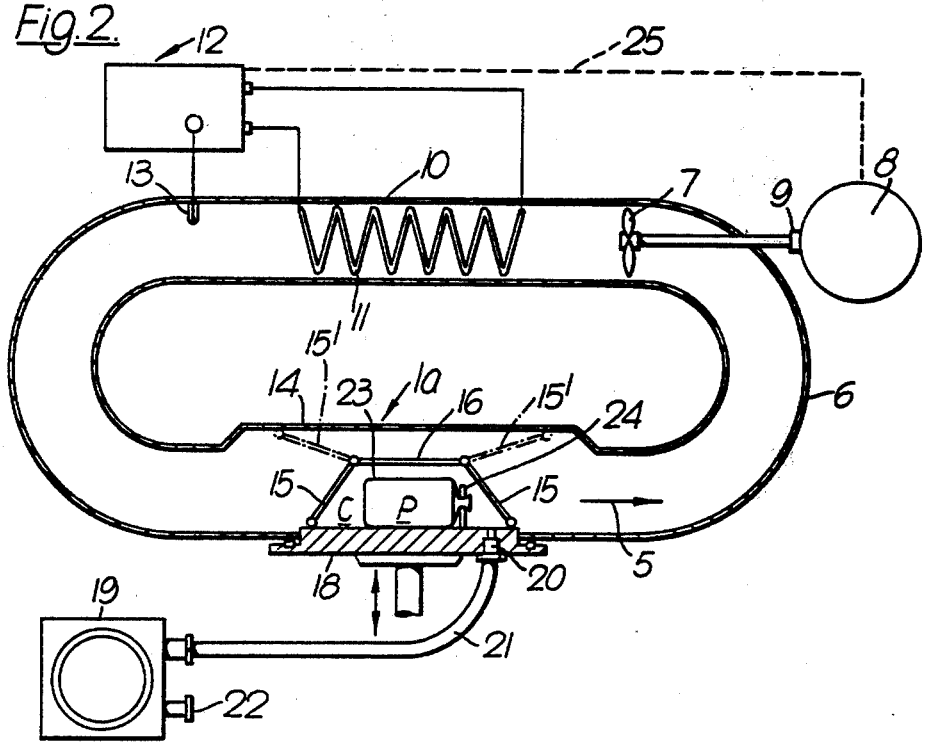
FIG. 2 is a schematic side elevational view of an alternative embodiment.

In FIG. 2, the working section 1*a* has a raised ceiling 14 which cooperates with a pair of movable shutters 15 so that when the shutters are in their broken line positions 15' all the circulating hot gas passes beneath a fixed baffle 16 whereas when the shutters 15 are in their solid line positions they define, together with a package support tray 18, a closed vacuum chamber C and will divert the hot gas around the outside of this vacuum chamber C through the gap remaining between fixed baffle 16 and the raised ceiling 14 of the working section 1*a*.

The vacuum chamber C is adapted to be evacuated by means of a vacuum pump 19 which communicates with an aperture 20 in the support tray 18 by way of a vacuum line 21 and thereby pulls air from the chamber C along vacuum line 21 and discharges it through discharge port 22.

As can also be seen in FIG. 2, the neck of the bag 23 of package P which envelops the product is arranged in conjunction with an "in-chamber" gathering and clipping device 24 which is capable of effecting clipping after the vacuum chamber C has been closed.

An "in-chamber" bag neck gathering and clipping system is disclosed and claimed in our British Pat. No. 1,353,157 and this form of clipping system could readily be adapted by the expert in the art for use in the chamber C illustrated in FIG. 2.

With the FIG. 2 embodiment, it will therefore be possible to carry out the various operations of evacuating the bag, gathering the bag neck, closing the bag neck and shrinking the package without removing the package from the support tray 18 and it will thereby be possible to cut down the time taken to convert a loaded bag into an evacuated, shrink-tidied package.

Although not specifically illustrated in FIG. 2, it will of course be possible for the package P to be positioned on a grid similar to that illustrated at 4 in FIG. 1, thereby ensuring that the maximum possible area of the bag 23 is exposed to the passing air flow during shrinking.

By way of example, the operation of the two illustrated embodiments of gas shrink tunnel will now be described.

Referring firstly to the FIG. 1 embodiment, the motor 8 is energised to drive the fan 7 at the speed required to provide a given rate of air flow along the working section 1 The selected fan speed will be monitored by the control device 12 which also ensures that the temperature sensed by transducer 13 is at a given value corresponding to the optimum temperature for efficient shrinking of the envelope of the package P onto the product in the working section.

For complete automation of control of the shrinking parameters, a control connection 25 between the control device 12 and the motor 8 is illustrated in broken lines for each embodiment.

Once the temperature of the air has been brought up to the desired value and the rate of air circulation through the return flow tunnel is as required, the shrinking operation can be commenced by removing the package support 2 from the working section of the tunnel, placing a package P consisting of a closed, loaded envelope (in this case a plastics bag secured by a metal fastening clip) on the package support bars 4 and then reinserting the package support member 2 into position in the working section and holding it there for the desired shrinkage time.

In practice it has been found that with single- and multi-layer polyvinylidene chloride based bags having a film thickness of 3 mils and with a gas flow rate of 590 meters per minute (corresponding to 35.5 $m^3$/minute) and a temperature of 220° C., good shrinkage (in terms of a tidy package) was obtained after a mere 2 seconds shrinkage time. Dropping the temperature to 210° C. at an air speed of 590 meters/minute could still give good shrinkage results if the shrinkage time is increased to 4 seconds. Reducing the bag thickness will enable a reduction in the shrinking time.

At the end of the predetermined exposure time, for example 2 seconds at 590 meters/minute and 220° C., the product support 2 is withdrawn from the working section into its broken line position as viewed in FIG. 1 to allow the shrunk package P to be removed and replaced by a fresh clipped, evacuated bag so that the package support 2 can then be re-inserted in the working section for shrinkage of the next package.

After the last package has been shrunk the heater 11 will be de-energised, for example, manually, and the motor 8 allowed to run down so as to maintain cooling air flow over the heater 11 in the return section of the tunnel while the heater cools off.

The FIG. 2 embodiment operates in much the same way except that the cycle of operations for loading the working section is rather more complex.

Assuming that the air flow has been set up at the correct flow rate and temperature, then with the shutters 15 in their solid line positions the package support tray 18 is then lowered and a bag 23, already containing a product, (for example a block of cheese, or a cut of meat, or other food article) is placed on the tray 18 with the bag neck in register with the clipping device 24.

The support tray 18 is then raised into the FIG. 2 position and vacuum is applied through the line 21 by way of the vacuum pump 19. If desired, the application of vacuum to the tray 18 may be achieved by providing a closure valve in the aperture 20 and opening this valve when it is desired to evacuate the chamber C.

Once the chamber C has been evacuated, and the residual air pockets within the bag 23 have been withdrawn by the application of vacuum to escape through the neck of the bag, the clipping device 24 is operated to clip, and thereby completely close and seal off, the neck of the bag 23.

At this stage the application of vacuum through aperture 20 ceases (and if desired the chamber C may be vented before opening, by means of any suitable venting means, not shown).

The shutters 15 are then moved into the broken line positions 15' and this will allow hot, fast moving air to pass over the package P consisting of now evacuated bag 23 and the enclosed product to effect shrinkage. When the desired shrinkage time has elapsed (say 2 seconds) the shutters 15 are once again moved to their solid line positions to deflect the hot air flow through the by-pass section defined by the gap between the baffle 16 and the ceiling 14 of the working section to enable the package support tray 18 to be lowered for release of the vacuum skin package P, and to allow replacement by a fresh loaded bag.

In accordance with our British Pat. No. 1,353,157 it may be possible for automatic loading of the tray 18 to be effected if the product and the bag 23 are moved, mouth trailing, onto the support tray 18 by any suitable conveyor mechanism so as to pass between two opposed gathering arms of the clipping mechanism 24. The gathering arms can then cooperate to effect gathering of the neck of the bag 23 after the tray 18 has been raised into its FIG. 2 position and the vacuum has been applied to the chamber C by way of line 21.

Alternatively the introduction of bags into the tunnel, and removal therefrom, may be performed using a conveyor, for example a belt conveyor, a roller conveyor or a rod conveyor, to advance a stream of loaded bags across the tunnel at the working or shrinking station.

Figure 3:
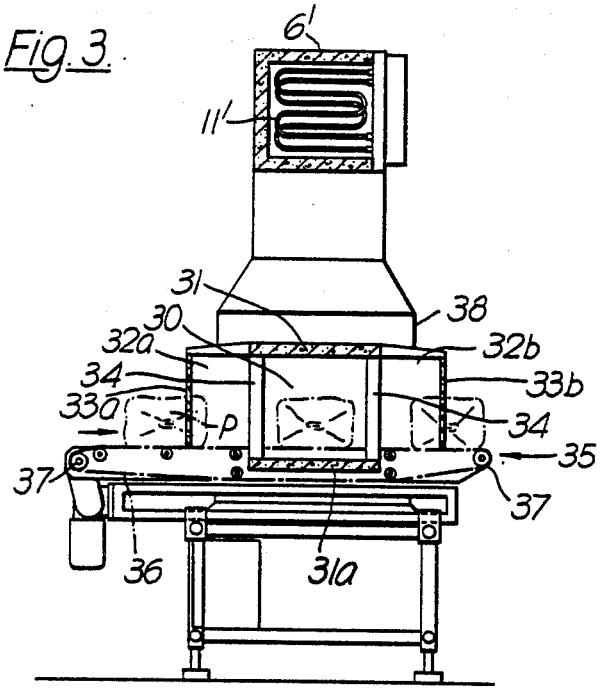
FIG. 3 is a cross-sectional view through the working section of the tunnel and showing in this case a vertical return circuit, the section being taken on line III—III of FIG. 4.
Figure 4:
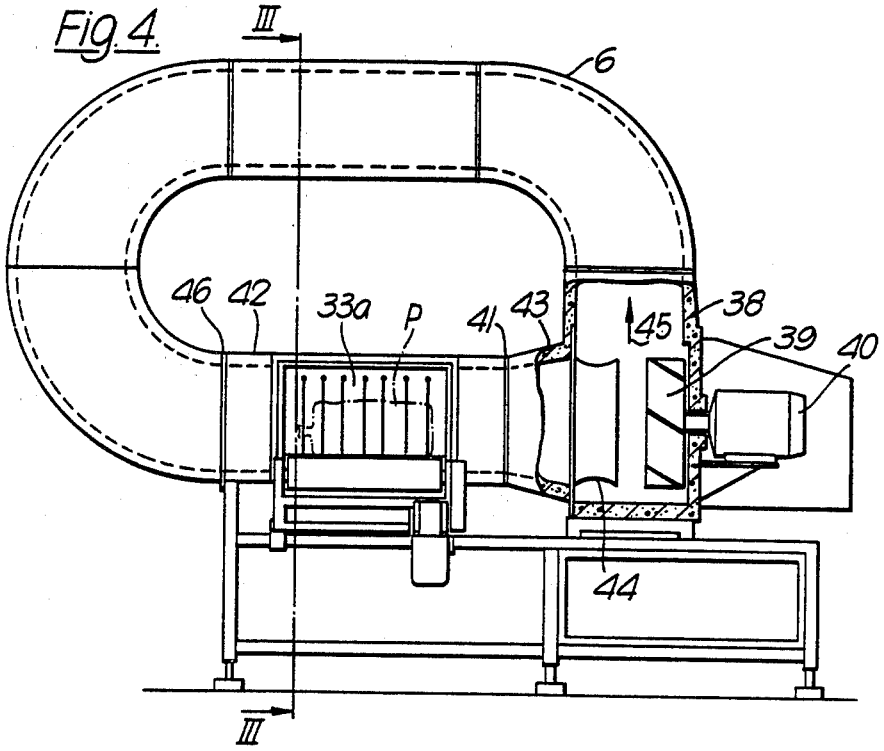
FIG. 4 is a side elevational, partly schematic, view showing the vertical return circuit tunnel of FIG. 3.

Such an arrangement is illustrated in FIGS. 3 and 4 where the return circuit 6 of the tunnel is in this case in the vertical plane. The entire tunnel is lined with thermally insulating material over the floor, ceiling and side walls.

The working station has a central portion of square cross-section having a ceiling 31 and an inlet ante-chamber 32 *a* on one side and an outlet ante-chamber 32 *b* on the other side. The two ante-chambers are closed off from atmosphere by respective yieldable curtains 33 *a* and 33 *b* which, although not completely air-tight, provide a sufficiently thorough obstruction to air inlet (through curtain 33 *a*) and outlet (through curtain 33 *b*) as to avoid undue energy losses by escape of the hot shrink air through the curtains. The side walls 34 of the tunnel are cut away at the working section to allow packages P to be passed transversely through the working section, in either continuous or intermittent manner, on a belt conveyor 35 which comprises one continuous belt 36 passing around two main outrider guide rollers 37 and various smaller guide rollers shown in FIG. 3.

As shown in FIG. 4, a vertical duct 38, again of thermally insulating material, extends vertically upwardly from the fan region adjacent the downstream end 41 of the working section in the lower tunnel portion. Air passing around the return circuit 6, the whole of which is also thermally insulated, then passes over a heating element 11 (FIG. 3) before passing back to the inlet end 46 of the working section of the tunnel to pass over the package P now on the conveyor belt passing through the working section.

As in the embodiments of FIGS. 1 and 2, the direction of air flow through the working section is coaxial between inlet 46 and outlet 41 consequently there will be a substantially square cross-section air jet passing through the working section between the ante-chamber 32 *a* and 32 *b* and having a cross-sectional area corresponding to the area bounded by the ceiling 31, the floor 31 *a*, and the two side walls 34 of the working section. There will be little or no movement of air in the ante-chambers 32 *a* and 32 *b* and it will therefore be possible to open the inlet curtain 33 *a* for admission of a fresh package P to be shrunk or the outlet curtain 33 *b* for removal of a package just shrunk, without causing any serious perturbation to the flow through the working section.

In contrast to the embodiment of FIGS. 1 and 2, the embodiment of FIG. 3 uses a centrifugal fan 39 driven by a 15 horse power electric motor 40 capable of pumping 10,000 cubic meters per hour under a pressure head of 250 mm. water gauge. In this case there is no reduction gearbox and the centrifugal fan 39 is driven by direct drive from the motor 40.

As air leaves the downstream end 41 of the lower run 42 of the tunnel, it enters a diffuser section 43 and then into a convergent-divergent throat nozzle 44 to be discharged in the form of a slightly divergent jet directed towards the centre of the centrifugal fan 39 which then impels the air vertically upwardly along the vertical duct 38 and into the return circuit 6 as depicted by arrow 45.

The influence of the nozzle 44 discharging the outlet air flow from the lower tunnel section into the low pressure region near the centre of the centrifugal fan 39 is such as to maintain the flow of air between the inlet 46 and the outlet 41 of the lower section 42 of the tunnel in substantially coaxial configuration thereby reducing the tendency for loss of energy in hot air passing through the inlet and outlet curtains 33 *a* and 33 *b*, respectively.

In the preferred case, the heating element 11 has an output of 30 kw. to generate an air temperature of 250° C., and the conveyor belt 36 is moving at a speed of 12 meters per minute giving a dwell time of approximately 2 seconds between (a) arrival of the first portion of the package P leaving the inlet ante-chamber 32 *a* and entering the stream of hot air through the working section 30, and (b) departure of that same portion of the package P from the hot air stream as the package enters the outlet ante-chamber 32 *b*. In this case the working section 30 is approximately 0.4 meters in both width and height.

The enhanced efficiency of shrinkage using air, rather than much higher thermal capacity media such as water, is due to the relatively high mass flow rates of air available with a return flow shrink tunnel and also the conservation of heat by both thermally insulating the tunnel walls and ensuring that all the air from the working section is returned over the heater 11' to replinish the heat quantity carried by the air before it next contacts a package P.

By driving the shrinkage air axially along the working section of the tunnel and having the directions of entry of the hot air into the working section and withdrawal of the spent air from the working section in a coaxial, or substantially coaxial, arrangement, as shown in FIG. 1, FIG. 2, and FIG. 3 (see outlet nozzle 44), it is ensured that high mass flow rates of air can be achieved and consequently a high effective thermal capacity of the shrinkage flow can be realised.

With this embodiment also a thermal transducer can be installed in the air flow, preferably just after the heater, to give an indication of the temperature of the air passing from the heater. The output from this thermal transducer can be used to control the speed of the fan and/or the energisation of the heater whereby operation of the shrink tunnel can be properly controlled to give reliable operation in use thereof.

What we claim is:

1. A shrink tunnel for use in shrink packaging articles, comprising:

means defining a work section with an inlet end and an outlet end;

means defining a return section communicating with said inlet end and said outlet end;

velocity boosting means located within said means for defining said return section for boosting the velocity of air traveling through said return section;

heating means for heating said air located within said means defining said return section; and control means responsive to air temperature for controling said velocity boosting means.

2. A shrink tunnel according to claim 1, and including an air heater element and a fan which both carries out said velocity boosting and induces air flow across said heater.

3. A shrink tunnel according to claim 2, wherein said control means is effective to control the energy supply to said heating means.

4. A shrink tunnel according to claim 1, wherein the working section includes a support member mounted for movement into and out of the working section for bringing a closed, heat-shrinkage bag into the path of hot shrink air passing through the working section.

5. A shrink tunnel according to claim 1, wherein said working section communicates with evacuation means, and includes means for alternately diverting the hot shrink air around the evacuated section of said working section while the package is being evacuated and closed or passing it through the vacuum chamber to shrink an already evacuated and closed package.

6. A shrink tunnel according to claim 5, wherein said means for alternately diverting comprise a pair of shutters having a first position in which they guide all the hot shrink air to one side of a baffle and through the location where a filled bag will, in use be positioned, and a section position in which they define together with the baffle a vacuum chamber past the outside of which the air is caused to flow.

7. A shrink tunnel according to claim 1, further including a conveyor for carrying packages transversely through the working section, an inlet ante-chamber through which said conveyor passes the packages before entering the working section, and an outlet ante-chamber through which the conveyor passes the packages after leaving the working section, and means for closing said inlet and outlet ante-chambers from atmosphere.

8. A shrink tunnel according to claim 6, wherein said means for closing said inlet and outlet ante-chambers to atmosphere comprise flexible curtains provided with slits defining parallel fingers which yield to allow a package to pass through the curtain while normally resisting passage of air through the curtain.

9. A shrink tunnel according to claim 6 or 7, wherein said return section is in the vertical plane and said conveyor belt moves the packages in a horizontal direction.

* * * * *